US007845274B2

(12) United States Patent
Elschner et al.

(10) Patent No.: US 7,845,274 B2
(45) Date of Patent: Dec. 7, 2010

(54) WEB-FED PRINTING PRESS

(75) Inventors: Jens Elschner, Plauen (DE); Andreas Mueller, Plauen (DE); Ralf Schaedlich, Plauen (DE); Uwe Schenderlein, Hohndorf (DE); Ralf Werner, Plauen (DE)

(73) Assignee: Man Roland Druckmaschinen AG, Augsburg (DE)

( * ) Notice: Subject to any disclaimer, the term of this patent is extended or adjusted under 35 U.S.C. 154(b) by 464 days.

(21) Appl. No.: 11/336,731

(22) Filed: Jan. 20, 2006

(65) Prior Publication Data

US 2006/0187472 A1 Aug. 24, 2006

(30) Foreign Application Priority Data

Jan. 20, 2005 (DE) ..... 10 2005 002 847

(51) Int. Cl.
*B41F 13/54* (2006.01)

(52) U.S. Cl. ..... 101/181; 101/180; 101/220; 101/221

(58) Field of Classification Search ..... 101/180, 101/220, 227, 228, 181, 221; *B41F 13/54*
See application file for complete search history.

(56) References Cited

U.S. PATENT DOCUMENTS

| | | | | |
|---|---|---|---|---|
| 3,470,816 | A | 10/1969 | Piecha et al. | |
| 4,831,926 | A * | 5/1989 | Bowman et al. | 101/138 |
| 5,129,321 | A * | 7/1992 | Fadner | 101/467 |
| 5,197,385 | A | 3/1993 | Burger | |
| 5,540,149 | A | 7/1996 | Hoge | |
| 5,547,225 | A | 8/1996 | DeAngelis | |
| 5,697,297 | A | 12/1997 | Rasmussen | |
| 5,875,720 | A * | 3/1999 | Weiss et al. | 101/488 |
| 5,970,870 | A * | 10/1999 | Shiba et al. | 101/137 |
| 6,125,751 | A * | 10/2000 | Korem | 101/180 |
| 6,513,427 | B2 * | 2/2003 | Pautrat | 101/228 |
| 2001/0029856 | A1 * | 10/2001 | Pautrat | 101/228 |
| 2002/0078839 | A1 * | 6/2002 | Walczak et al. | 101/217 |
| 2004/0216630 | A1 | 11/2004 | Zimich et al. | |

(Continued)

FOREIGN PATENT DOCUMENTS

DE 199 55 084 A1 5/2001

(Continued)

OTHER PUBLICATIONS

Boris Fuchs, Singlem and Double Width vs. Single and Double Circumference, Ifra Symposium: Press Developments, Jan. 2000, Newspaper Techniques, pp. 28-30.*

(Continued)

*Primary Examiner*—Judy Nguyen
*Assistant Examiner*—Jennifer Simmons
(74) *Attorney, Agent, or Firm*—Crowell & Moring LLP

(57) ABSTRACT

A web-fed printing press, in particular a newspaper printing press having at least two printing press subsystems, is disclosed. Each printing press subsystem has a printing unit comprised of several printing mechanisms, a web guidance unit for conveying printed and unprinted substrate webs and a turning bar unit having several turning bars. The printing press subsystems guide the printed substrate webs over at least one shared folding unit. At least one printing press subsystem is designed differently in comparison with the other or each other printing press subsystem such that substrate webs are printable with a different number of print pages in the printing press subsystems.

12 Claims, 2 Drawing Sheets

U.S. PATENT DOCUMENTS

| | | | | |
|---|---|---|---|---|
| 2004/0231536 | A1 * | 11/2004 | Gerner et al. | 101/217 |
| 2005/0257702 | A1 * | 11/2005 | Eckert et al. | 101/180 |

FOREIGN PATENT DOCUMENTS

| | | | |
|---|---|---|---|
| DE | 10238010 | A1 * | 3/2004 |
| WO | WO2004/024448 | * | 3/2004 |

OTHER PUBLICATIONS

Boris Fuchs, Single and Double Width vs. Single and Double Circumference, Ifra Symposium: Press Developments, Jan. 2000, Newspaper techniques, pp. 28-30.

Dipl.-Ing. Gerd Finkbeiner, Investitionsentscheidungen im Zeitungsdruck sollten sich immer an der geplanten Auslastung orientieren, Deutscher Drucker, 29 Sep. 30, 1993, No. 36, Ostfildern (Ruit), DE, pp. 35-37.

* cited by examiner

WEB-FED PRINTING PRESS

This application claims the priority of German Patent Document No. 10 2005 002 847.0, filed Jan. 20, 2005, the disclosure of which is expressly incorporated by reference herein.

BACKGROUND AND SUMMARY OF THE INVENTION

The invention relates to a web-fed printing press.

Web-fed printing presses are known, consisting of at least two printing press subsystems, where the printing press subsystems guide printed substrate webs over at least one shared folding unit. Printing press subsystems are understood to include all technical facilities and/or modules of a web-fed printing press that are responsible for printing substrate webs and conveying the substrate webs, including turning the same, in the direction of a shared folding unit.

In the state of the art, web-fed printing press systems are differentiated with regard to the print pages printable in the same, namely with regard to the print pages printable on a substrate side by side in the longitudinal direction and in succession in the circumferential direction using the corresponding plate cylinders. With a 2/1 printing press subsystem, two print pages are printable on a substrate side by side in the longitudinal direction, i.e., in the axial direction, with the particular plate cylinders and one print page is printable on a substrate in the circumferential direction. With a 4/2 printing press subsystem, four print pages are printable side by side in the longitudinal direction and two print pages are printable in succession in the circumferential direction. In general terms, with an X/Y printing press subsystem, X print pages can be printed side by side in the longitudinal direction and Y print pages can be printed in succession in the circumferential direction. Conventional printing press subsystems are 2/1, 3/1, 4/1, 2/2, 3/2, 4/2 and 6/2 printing press subsystems.

In the state of the art, exclusively printing press subsystems that are equal with regard to the number of print pages printable in the printing press subsystems are combined to form a web-fed printing press, i.e., in these systems the plate cylinders of all printing press subsystems are characterized by an identical number of printable print pages in the longitudinal direction and in the circumferential direction. This necessarily results in a limited flexibility of known web-fed printing presses.

Against this background, the problem on which the present invention is based is to create a novel web-fed printing press.

According to this invention, at least one printing press subsystem is designed differently in comparison with the other or any other printing press subsystem, such that substrate webs having a different number of print pages are printable in these printing press subsystems.

In the sense of the present invention, a web-fed printing press composed of several printing press subsystems which guide the printed substrate webs over at least one shared folding unit is provided, whereby the printing press subsystems of the web-fed printing press are differentiated such that substrate webs are printable with a different number of print pages in the printing press subsystems. In the sense of the present invention, differently designed printing press subsystems which guide the printed substrate webs over at least one shared folding unit are combined here for the first time in one web-fed printing press with regard to the number of printable print pages. This makes it possible to technologically optimize the manufacture of print products while the investment expenditure for a web-fed printing press can be minimized while increasing flexibility.

In the sense of the present invention, it is possible to combine in a web-fed printing press the advantages of printing press subsystems designed differently with regard to the print pages printable in the same. For example, printing press subsystems characterized by a smaller number of printable print pages side by side in the longitudinal direction in comparison with printing press subsystems that print a larger number of print pages side by side on one substrate web in the longitudinal direction have advantages with regard to web width variability. However, printing press subsystems that print a larger number of print pages side by side on one substrate web in the longitudinal direction have certain advantages with regard to page capacity. Printing press subsystems that print only one print page on a substrate web as seen in the circumferential direction have advantages with regard to the achievable product variety in comparison with printing press subsystems that print several print pages in succession on one substrate web in the circumferential direction. The individual advantages of the individual printing press subsystems can be combined with the web-fed printing press according to this invention.

The printing mechanisms of the printing press subsystems that are designed differently are themselves designed differently, so that a different number of print pages is printable in the longitudinal direction and/or in the circumferential direction of the corresponding plate cylinders.

According to an advantageous refinement of the present invention, the printing press subsystems are designed differently in that the substrate webs are printable by different printing methods in the printing press subsystems.

According to another advantageous refinement of the present invention, the printing press subsystems are designed differently in that the printing ink is applied to the substrate webs in the printing press subsystems by different ink application methods.

According to another advantageous refinement, a different substrate is printable in at least one printing press subsystem in comparison with the other or each other printing press subsystem.

Preferred refinements of this invention are derived from the following description. Exemplary embodiments of the invention are explained in greater detail with reference to the drawings without being limited to these embodiments.

DETAILED DESCRIPTION OF THE DRAWINGS

The present invention is described in greater detail below with reference to FIGS. 1 and 2.

Figure 1:
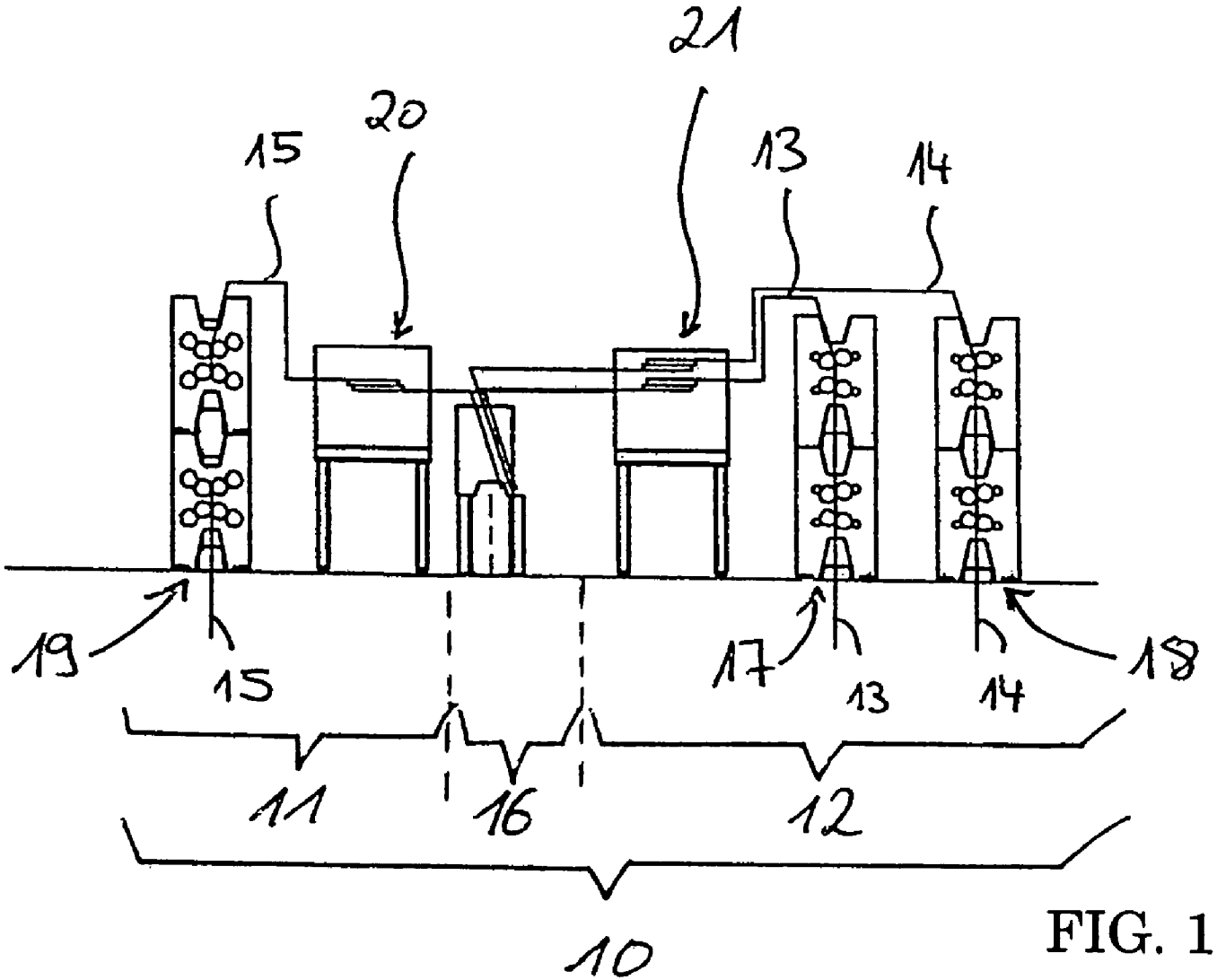
FIG. 1 shows an inventive web-fed printing press according to a first exemplary embodiment of the invention.

FIG. 1 shows a first exemplary embodiment of the inventive web-fed printing press 10, which is designed here as a newspaper rotary printing press and has two printing press subsystems 11, 12, whereby substrate webs 13, 14 and 15 that have been printed in the printing press subsystems 11, 12 are sent to a shared folding unit 16. Each of the printing press subsystems 11 and 12 has a printing unit comprised of multiple printing mechanisms, the printing mechanisms being configured into printing mechanism towers 17, 18 and 19. According to FIG. 1, the printing press subsystem 11 includes a printing mechanism tower 19, and the printing press subsystem 12 has two printing mechanism towers 17 and 18.

Each of the printing press subsystems 11, 12 also has a web guiding unit for conveying, i.e., moving, the printed and unprinted substrate webs 13, 14 and/or 15 over turning bar unit 20 and/or 21 with the help of which printed substrate webs can be supplied to the folding unit 16.

In the sense of the present invention, the printing mechanisms of the printing press subsystems 11 and 12 of the web-fed printing press 10 are designed differently in that a different number of print pages is printable in the longitudinal and circumferential directions of the corresponding plate cylinder, so that the printing subsystems differ with regard to the number of print pages printable on the substrate webs.

According to a first alternative, the printing mechanisms of the printing press subsystems differ in that a different number of print pages is printable in the longitudinal direction of the corresponding plate cylinders, whereas an identical number of print pages is printable in the circumferential direction. According to a second alternative, the printing mechanisms of the printing press subsystems differ such that a different number of print pages is printable in the circumferential direction of the corresponding plate cylinder whereas the number of printable print pages in the longitudinal direction is identical. According to a third alternative, a different number of print pages is printable on the substrate in both the longitudinal and circumferential directions of the corresponding plate cylinders. In cases in which a different number of print pages is printable in the circumferential direction of the corresponding plate cylinder in the differently designed printing press subsystems, the circumferences of the plate cylinders that are larger in the circumferential direction amount to an integral multiple of the circumference of the plate cylinder that is the smallest in the circumferential direction. In addition, in these cases the printing press subsystems are operated in so-called straight operation (uncollected printing operation) and not in so-called collect operation (collected printing operation).

In a concrete embodiment, the printing press subsystem 12 may be designed as a 4/2 printing press subsystem, and the printing press subsystem 11 may be designed as a 2/2 printing press subsystem. In this case, the plate cylinders of the particular printing mechanisms would print four print pages on the substrate webs 13 and 14 side by side in the longitudinal direction in the printing mechanisms 17 and 18 and would print two print pages in succession in the circumferential direction. The plate cylinders in the printing mechanism tower 19 would print two print pages on the substrate web 15 side by side in the longitudinal direction and would print two print pages in succession in the circumferential direction. The web-fed printing press 10 would then have a capacity of 40 print pages, taking into account printing the front and back sides of the substrate webs.

It is also possible to design the printing press subsystem 12 as a 6/2 printing press subsystem and to design the printing press subsystem 11 as a 2/2 printing press subsystem, so that the web-fed printing press then has a capacity of 56 print pages. Likewise, the printing press subsystem 12 may be designed as a 4/1 printing press subsystem and the printing press subsystem 11 may be designed as a 2/1 printing press subsystem, which then results in a capacity of 20 print pages for the web-fed printing press.

In the sense of the present invention, the printing press subsystems 11 and 12 of the web-fed printing press 10 may also be designed differently in that the substrate webs are printable by different printing methods in the respective printing press subsystems. Thus the printing mechanisms of the printing mechanism towers 17 and 18 of the printing press subsystem 12 may print the substrate web by offset printing, for example, whereas the printing mechanisms of the printing mechanism tower 19 of the printing press subsystem 11 may print by digital printing. In addition, other combinations of different printing methods are also possible, e.g., combinations of offset printing and flexographic printing or digital printing and flexographic printing.

In addition, different substrates, i.e., substrates having different properties, may be printed in the printing press subsystems 11 and 12.

Figure 2:
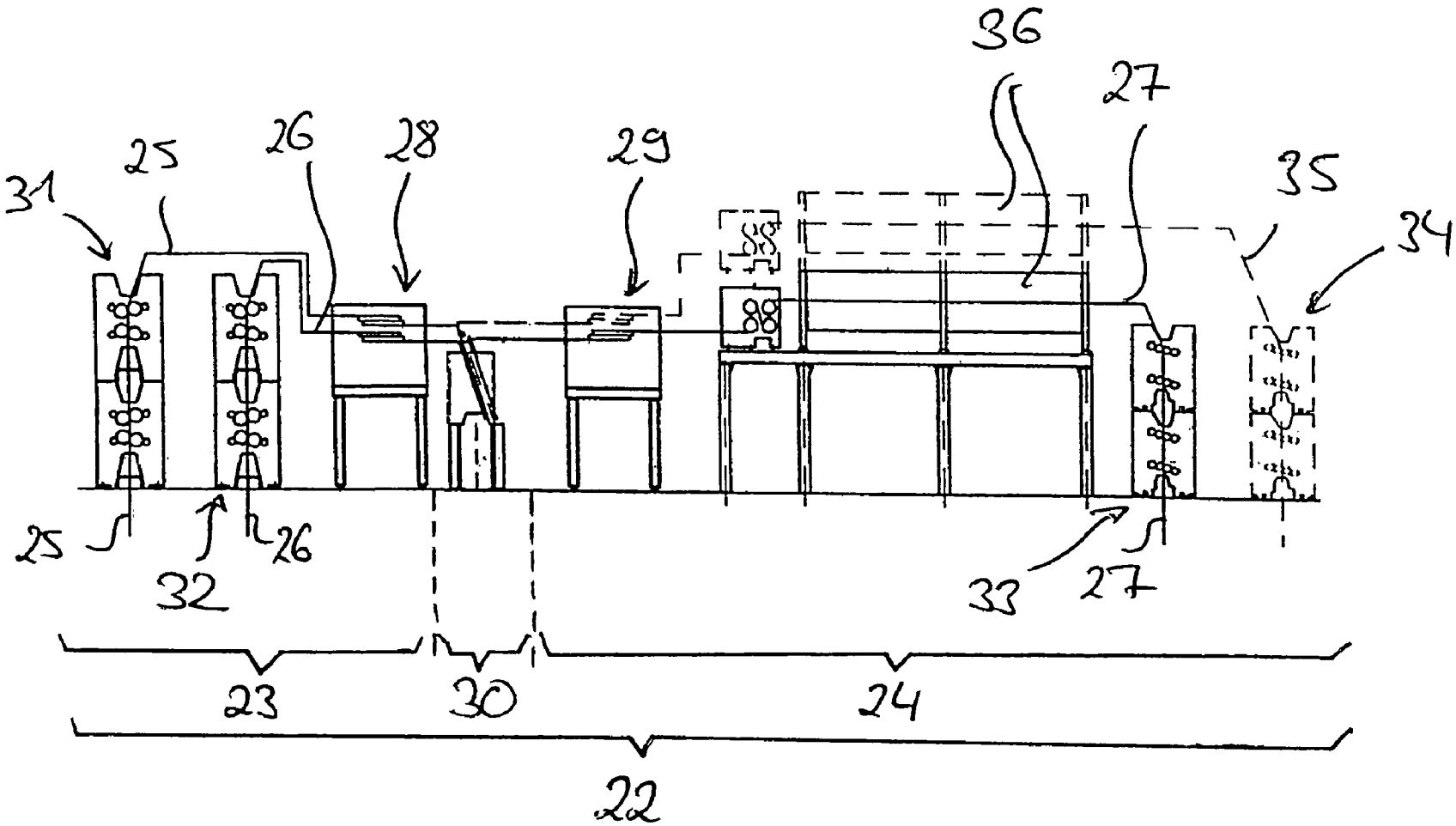
FIG. 2 shows an inventive web-fed printing press according to a second exemplary embodiment of the invention.

FIG. 2 shows a second exemplary embodiment of an inventive web-fed printing press 22, which in-turn consists of two printing press subsystems 23 and 24. Substrate webs 25, 26 and 27 may in-turn be printed in printing press subsystems 23 and 24, whereby the substrate webs 25 through 27 printed in printing press subsystems 23 and 24 may in-turn be supplied to a shared folding unit 30 via turning bar units 28 and 29. In the sense of the present invention, the two printing press subsystems 23 and 24 of the web-fed printing press 22 of FIG. 2 are in-turn designed differently in that substrate webs having a different number of print sides are printable in the two printing press subsystems 23 and 24. The printing mechanisms of printing press subsystems 23 and 24 may in-turn be designed differently so that a different number of print pages is printable on the substrate webs 25, 26 and 27 in the longitudinal direction and/or in the circumferential direction of the corresponding plate cylinders.

In the exemplary embodiment according to FIG. 2, the printing mechanisms of the printing press subsystem 23 are configured in the form of two printing mechanism towers 31 and 32. However, the printing press subsystem 24 has only one printing mechanism tower 33. Optionally, however, the printing press subsystem 24 may also have a second printing mechanism tower 34 for printing another substrate web 35, as illustrated with the dotted line in FIG. 2.

In the exemplary embodiment in FIG. 2, the printing press subsystems 23 and 24 also differ in that the printing ink is applied to the substrate webs in the printing press subsystems 23 and 24 using different ink application methods. For example, ink is applied in the printing press subsystem 23 by the so-called cold-set method and in the printing press subsystem 24 by the so-called heat-set method. Heat-set drying equipment of the printing press subsystem 24 is labeled with reference numeral 36 in FIG. 2.

In a concrete exemplary embodiment, the printing mechanisms of the printing mechanism towers 31 and 32 of the printing press subsystem 23 may be designed as so-called 6/2 printing mechanisms to provide a 6/2 printing press subsystem, in which case then six print pages can be printed side by side in the longitudinal direction on the substrate webs 25 and 26 to be printed in the printing press subsystem 23 using the corresponding plate cylinders, and in the circumferential direction two print pages can be printed in succession on the substrate webs 25 and 26. The printing mechanisms of the printing mechanism towers 27 and 34 of the printing press subsystem 24 may be designed as 2/2 printing mechanisms to provide a 2/2 printing press subsystem. Then the advantages of the 6/2 printing units with regard to page capacity can be combined with the advantages of the 2/2 printing units with regard to heat-set printing capability in a web-fed printing press.

Furthermore, in the exemplary embodiment in FIG. 2, the printing press subsystems 23 and 24 may also differ with regard to the printing method as well as the substrate webs to be printed.

In the exemplary embodiments according to FIGS. 1 and 2, the substrate webs printed in the differently designed printing press subsystems are sent to a shared folding unit. It should be pointed out that two or more shared folding units may also be provided.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

List of reference numerals:

10 web-fed printing press
11 printing press subsystem
12 printing press subsystem
13 substrate web
14 substrate web
15 substrate web
16 folding unit
17 printing mechanism tower
18 printing mechanism tower
19 printing mechanism tower
20 turning bar unit
21 turning bar unit
22 web-fed printing press
23 printing press subsystem
24 printing press subsystem
25 substrate web
26 substrate web
27 substrate web
28 turning bar unit
29 turning bar unit
30 folding unit
31 printing mechanism tower
32 printing mechanism tower
33 printing mechanism tower
34 printing mechanism tower
35 substrate web
36 heat-set drying unit

What is claimed is:

1. A web-fed printing press, in particular a newspaper rotary printing press comprising at least two printing press subsystems, each printing press subsystem having a printing unit comprised of several printing mechanisms, a web guidance unit for conveying printed and unprinted substrate webs and a turning bar unit having several turning bars, wherein the printing press subsystems guide the printed substrate webs over at least one shared folding unit, wherein at least one printing press subsystem is designed differently in comparison with the other or each other printing press subsystem wherein the printing mechanisms of the differently designed printing press subsystems are designed differently in that a different number of print pages is printable in a circumferential direction of corresponding plate cylinders, and wherein a circumference of the plate cylinders that are larger in the circumferential direction is an integral multiple of a circumference of the plate cylinders that are a smallest in the circumferential direction.

2. The web-fed printing press according to claim 1, wherein the printing mechanisms of the differently designed printing press subsystems are designed differently such that in addition a different number of print pages is printable in a longitudinal direction of the plate cylinders.

3. The web-fed printing press according to claim 1, wherein the printing press subsystems are operated in a straight operation.

4. The web-fed printing press according to claim 1, wherein the printing press subsystems are designed differently in that different printing methods are executable in the printing press subsystems.

5. The web-fed printing press according to claim 4, wherein printing is performed by digital printing in at least one printing press subsystem and wherein printing is performed by offset printing in the other or each other printing press subsystem.

6. The web-fed printing press according to claim 4, wherein printing is performed by flexographic printing in at least one printing press subsystem and wherein printing is performed by offset printing in the other or each other printing press subsystem.

7. The web-fed printing press according to claim 1, wherein the printing press subsystems are designed differently in that a printing ink is applied by different ink application methods in the printing press subsystems.

8. The web-fed printing press according to claim 7, wherein the printing ink is applied by a heat-set method in at least one printing press subsystem, and wherein the printing ink is applied in the other or each other printing press subsystem by a cold-set method.

9. The web-fed printing press according to claim 8, wherein the printing ink is applied by the heat-set method in printing press subsystems in which a small number of print pages are printed in a longitudinal direction of the corresponding plate cylinders and wherein the printing ink is applied by the cold-set method in printing press subsystems in which a large number of print pages are printed in a longitudinal direction of the corresponding plate cylinders.

10. The web-fed printing press according to claim 1, wherein in at least one printing press subsystem, a different substrate web is printable in comparison with the other or each other printing press subsystem.

11. A web-fed printing press, in particular a newspaper rotary printing press comprising at least two printing press subsystems, each printing press subsystem having a printing unit comprised of several printing mechanisms, a web guidance unit for conveying printed and unprinted substrate webs and a turning bar unit having several turning bars, wherein the printing press subsystems guide the printed substrate webs over at least one shared folding unit, wherein at least one printing press subsystem is designed differently in comparison with the other or each other printing press subsystem wherein the printing mechanisms of the differently designed printing press subsystems are designed differently in that a different number of print pages is printable in a circumferential direction of corresponding plate cylinders, and wherein a circumference of the plate cylinders that are larger in the circumferential direction is an integral multiple of a circumference of the plate cylinders that are a smallest in the circumferential direction, wherein the printing mechanisms of the differently designed printing press subsystems are designed differently such that in addition a different number of print pages is printable in a longitudinal direction of the plate cylinders, and wherein the printing press subsystems are designed differently in that a printing ink is applied by different ink application methods in the printing press subsystems such that the printing ink is applied by a heat-set method in printing press subsystems in which a small number of print pages are printed in a longitudinal direction of the corresponding plate cylinders and wherein the printing ink is applied by a cold-set method in printing press subsystems in which a large number of print pages are printed in a longitudinal direction of the corresponding plate cylinders.

12. The web-fed printing press according to claim 11, wherein in at least one printing press subsystem, a different substrate web is printable in comparison with the other or each other printing press subsystem.

* * * * *